US011191420B2

(12) United States Patent
Thiyagarajan et al.

(10) Patent No.: US 11,191,420 B2
(45) Date of Patent: Dec. 7, 2021

(54) DISHWASHING APPLIANCE HAVING A MULTI-ZONE DRYING ASSEMBLY

(71) Applicant: Haier US Appliance Solutions, Inc., Wilmington, DE (US)

(72) Inventors: Ramasamy Thiyagarajan, Louisville, KY (US); Matthew David Mersch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 91 days.

(21) Appl. No.: 16/673,112

(22) Filed: Nov. 4, 2019

(65) Prior Publication Data

US 2021/0127944 A1 May 6, 2021

(51) Int. Cl.
*A47L 15/48* (2006.01)
*A47L 15/42* (2006.01)

(52) U.S. Cl.
CPC ..... *A47L 15/488* (2013.01); *A47L 15/4225* (2013.01); *A47L 15/4278* (2013.01)

(58) Field of Classification Search
CPC . A47L 15/488; A47L 15/4278; A47L 15/4225
See application file for complete search history.

(56) References Cited

U.S. PATENT DOCUMENTS 7,887,643 B2 2/2011 Stelzer et al.
7,901,518 B2 3/2011 Berner et al.
10,251,529 B2 4/2019 Kim et al.
2006/0231122 A1* 10/2006 Stelzer ..... A47L 15/486 134/18
2008/0264458 A1* 10/2008 Berner ..... A47L 15/488 134/57 D
2009/0038653 A1* 2/2009 Kang ..... A47L 15/483 134/105

FOREIGN PATENT DOCUMENTS

CN 106606342 A * 5/2017
KR 20100020788 A * 2/2010
KR 20100020788 A 2/2010
WO WO-2018077635 A1 * 5/2018 ..... A47L 15/0047
WO WO2019037981 A1 2/2019

* cited by examiner

*Primary Examiner* — Michael E Barr
*Assistant Examiner* — Pallavi Chitta
(74) *Attorney, Agent, or Firm* — Dority & Manning, P.A.

(57) ABSTRACT

A dishwashing appliance, as provided herein, may include a cabinet, a tub, a pump, a spray assembly, a first fluid path, and a second fluid path. The first fluid path may extend from a first path inlet to a first path outlet to recirculate air within a wash chamber. The first path inlet may be defined in fluid communication between the wash chamber and the first path outlet. The second fluid path may extend from a second path inlet to a second path outlet to direct ambient air to the wash chamber. The second path inlet may be defined in fluid communication between an ambient environment surrounding the dishwashing appliance and the second path outlet. The second path outlet may be defined in fluid communication between the second path inlet and the wash chamber downstream from the second path inlet.

20 Claims, 8 Drawing Sheets

DISHWASHING APPLIANCE HAVING A MULTI-ZONE DRYING ASSEMBLY

FIELD OF THE INVENTION

The present subject matter relates generally to washer appliances, and more particularly to dishwashing appliances having an assembly for circulating drying air therein.

BACKGROUND OF THE INVENTION

Dishwashing appliances generally include a tub that defines a wash chamber for receipt of articles for washing. Certain dishwasher assemblies also include a rack assembly slidably mounted within the wash chamber. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

After the spray assemblies have washed or sprayed articles on the rack assemblies, typical dishwashing appliances provide one or more features to circulate air and remove moisture from (i.e., dry) the articles. Commonly, such features are provided as part of a closed loop or an open loop system. Closed loop systems often draw air from the wash chamber through a small inlet in one corner of the door before returning that same air to the wash chamber (e.g., after being heated or dried). Open loop systems generally motivate air from the ambient environment to the wash chamber, such as through a small vent within the door.

These existing system present a number of drawbacks. For instance, even air circulation or drying is often difficult to achieve through the small inlets or vents of existing appliances. Simply enlarging, relocating, or multiplying the inlets or vents risks trapping moisture within the door or cabinet. Additionally or alternatively, existing appliances have difficulty managing the moisture or humidity within the air being circulated. For instance, existing systems may have difficulty removing moisture from air in a closed loop system. In an open loop system, performance may be uneven or undesirably influenced by humidity in the ambient air.

There is, thus, a need for an improved dishwashing appliance. In particular, it would be advantageous to provide a dishwashing appliance with one or more features to evenly circulate air, control moisture within circulated air, or otherwise dry the contents of as wash chamber.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwashing appliance is provided. The dishwashing appliance may include a cabinet, a tub, a pump, a spray assembly, a first fluid path, and a second fluid path. The tub may be housed within the cabinet and define a wash chamber. The pump may be configured to deliver a wash fluid to the wash chamber. The spray assembly may be housed within the wash chamber of the tub in fluid communication with the pump to receive wash fluid therefrom. The first fluid path may extend from a first path inlet to a first path outlet to recirculate air within the wash chamber. The first path inlet may be defined in fluid communication between the wash chamber and the first path outlet. The first path outlet may be defined in fluid communication between the first path inlet and the wash chamber downstream from the first path inlet. The second fluid path may extend from a second path inlet to a second path outlet to direct ambient air to the wash chamber. The second path inlet may be defined in fluid communication between an ambient environment surrounding the dishwashing appliance and the second path outlet. The second path outlet may be defined in fluid communication between the second path inlet and the wash chamber downstream from the second path inlet.

In another exemplary aspect of the present disclosure, a dishwashing appliance is provided. The dishwashing appliance may include a cabinet, a tub, a pump, a spray assembly, a door, an intake nozzle bar, a first output nozzle, a second output nozzle, a first fluid path, and a second fluid path. The cabinet may define a mutually-perpendicular vertical direction, lateral direction, and transverse direction. The tub may be housed within the cabinet and defining a wash chamber. The pump may be configured to deliver a wash fluid to the wash chamber. The spray assembly may be housed within the wash chamber of the tub in fluid communication with the pump to receive wash fluid therefrom. The door may be rotatably attached to the cabinet to selectively restrict access to the wash chamber in a closed position. The door may extend in the lateral direction from a first side to a second side. The intake nozzle bar may be mounted on an inner surface of the door. The intake nozzle bar may extend in the lateral direction between a first end proximal to the first side and a second end proximal to the second side. The first output nozzle may be mounted on the inner surface of the door proximal to the first side. The second output nozzle may be mounted on the inner surface of the door proximal to the second side. The first fluid path may extend from a first path inlet defined at the intake nozzle bar to a first path outlet defined at the first output nozzle to recirculate air within the wash chamber. The second fluid path may extend from a second path inlet to a second path outlet defined at the second output nozzle to direct ambient air to the wash chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
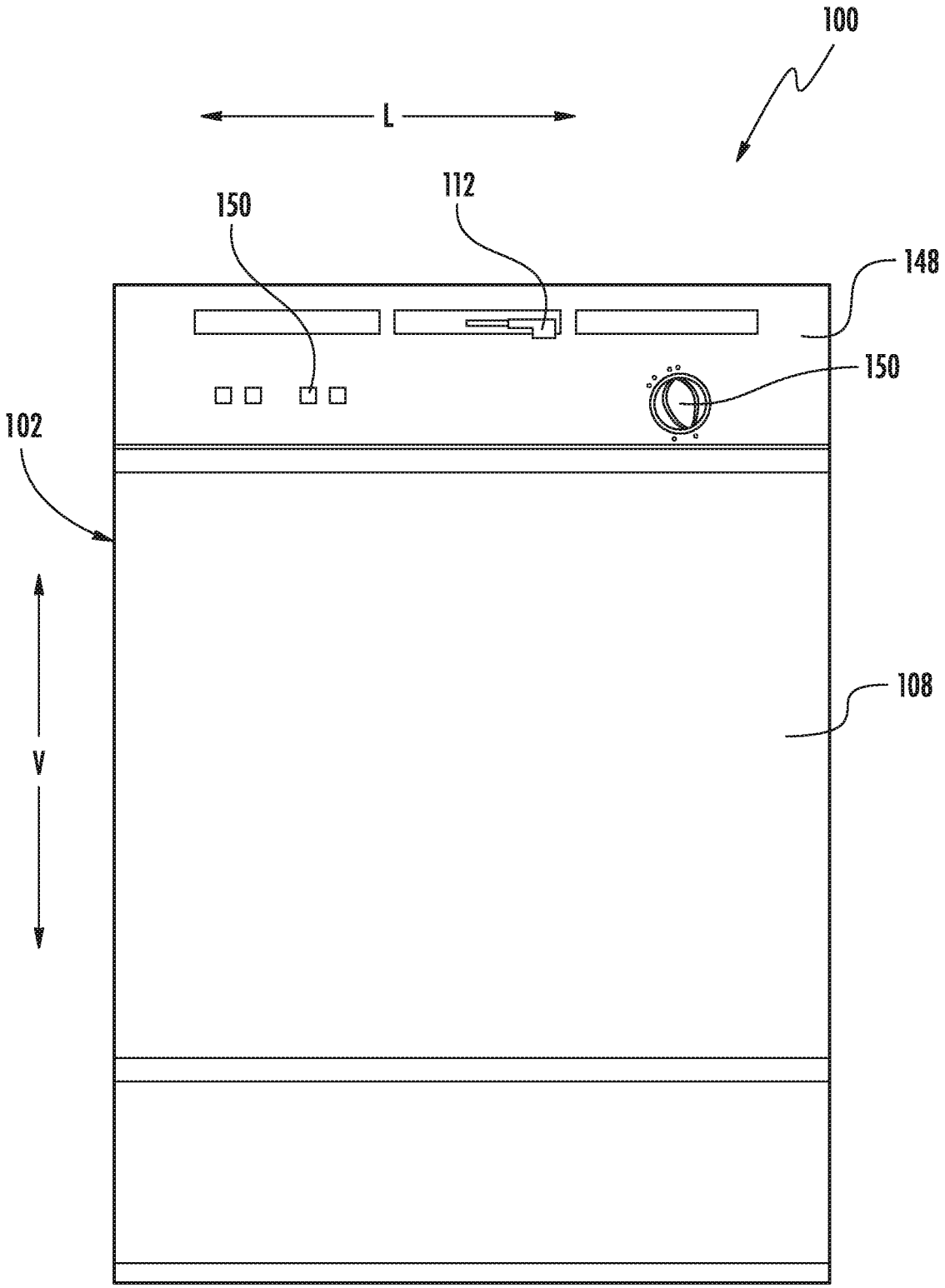
FIG. 1 provides a front elevation view of a dishwashing appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
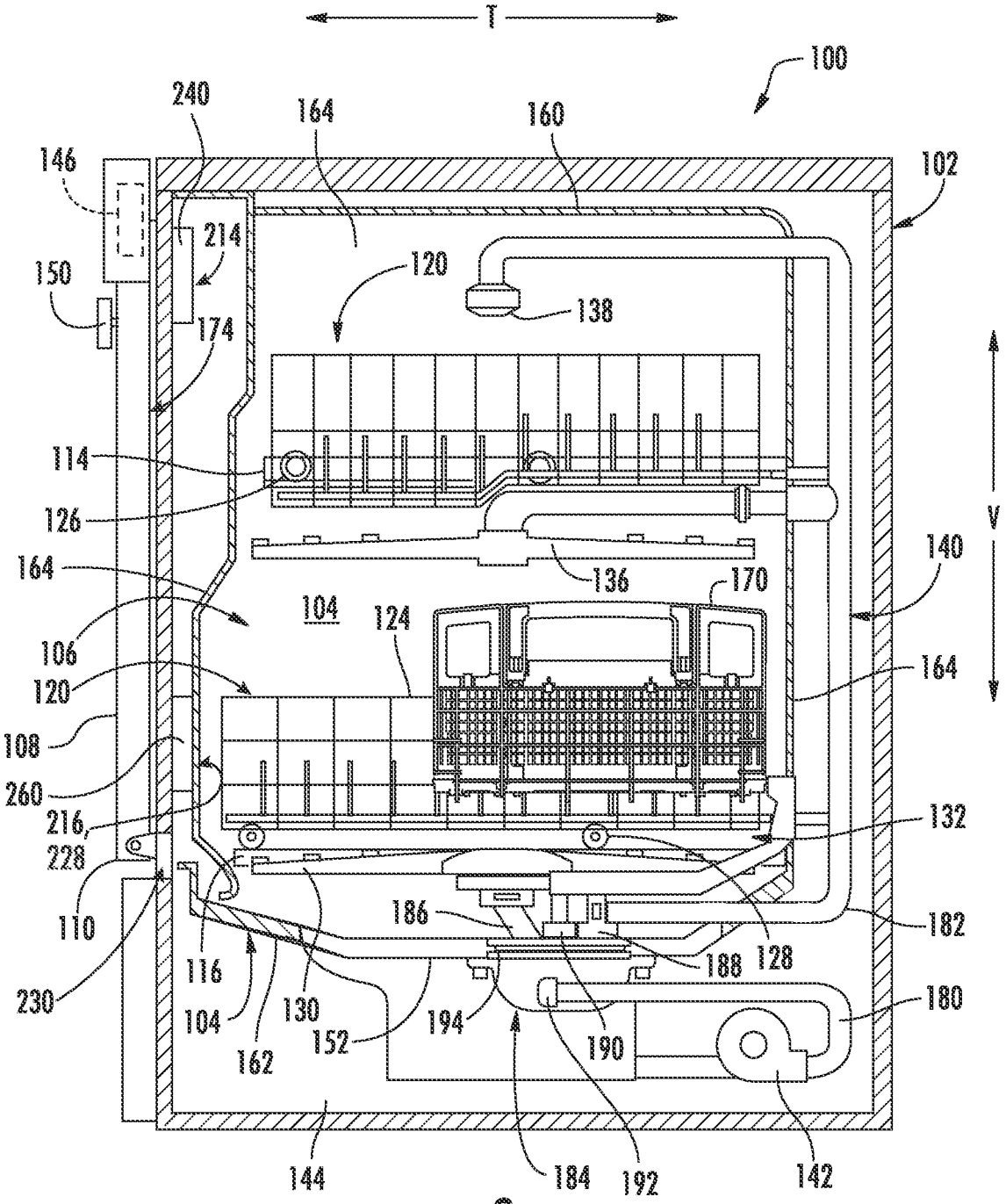
FIG. 2 provides a side, section view of the exemplary dishwashing appliance of FIG. 1.

Turning now to the figures, FIGS. 1 and 2 illustrate a domestic dishwashing appliance 100 according to exemplary embodiments of the present disclosure. As shown in FIGS. 1 and 2, the dishwashing appliance 100 may include a cabinet 102 having a tub 104 therein defining a wash chamber 106. The tub 104 may generally include a front opening and a door 108 hinged at its bottom 110 for rotatable movement between a closed or vertical position (shown in FIGS. 1 and 2), wherein wash chamber 106 is sealed shut for washing operation and access to wash chamber 106 is restricted, and a horizontal open position for loading and unloading of articles from the dishwashing appliance 100. As shown in FIG. 1, a latch 112 may be used to lock and unlock the door 108 for access to the chamber 106.

Generally, cabinet 102 may define a discrete vertical direction V, lateral direction L, and transverse direction T. Vertical direction V, lateral direction L, and transverse direction T are mutually perpendicular such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. However, in optional embodiments, the tub 104 may be formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside wash chamber 106, and a retracted position (shown in FIGS. 1 and 2) in which the rack 120, 122 is located inside wash chamber 106. This may be facilitated by rollers 126 and 128, for example, mounted onto racks 120 and 122, respectively.

In some embodiments, a silverware basket 170 is removably mounted to lower rack assembly 122. However, in alternative exemplary embodiments, the silverware basket 170 may also be selectively attached to other portions of dishwashing appliance 100 (e.g., door 108). The silverware basket 170 defines one or more storage chambers and is generally configured to receive of silverware, flatware, utensils, and the like, that are too small to be accommodated by the upper and lower rack assemblies 120, 122. The silverware basket 170 may be constructed of any suitable material (e.g., metal or plastic) and define a plurality of fluid slots for permitting wash fluid therethrough.

The dishwashing appliance 100 includes one or more spray assemblies housed within wash chamber 106. For instance, the dishwashing appliance 100 may include a lower spray-arm assembly 130 that is rotatably mounted within a lower region 132 of wash chamber 106 directly above the bottom wall 162 of the tub 104 so as to rotate in relatively close proximity to the rack assembly 122. As shown in FIG. 2, a mid-level spray-arm assembly 136 may be located in an upper region of wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of washing fluid flowing through the discharge ports. The resultant rotation of the lower spray-arm assembly 130 provides coverage of dishes and other dishwasher contents with a spray (e.g., a spray of washing fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In some such embodiments, input/output ("I/O") signals are routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally or alternatively, as shown in FIG. 2, a portion of the bottom wall 162 of the tub 104 may be configured as a tub sump portion 152 that is configured to accommodate one or more components of the fluid recirculation assembly 140 (e.g., a filter assembly or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Optionally, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Additionally, the diverter assembly 184 may also include a diverter valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Figure 3:
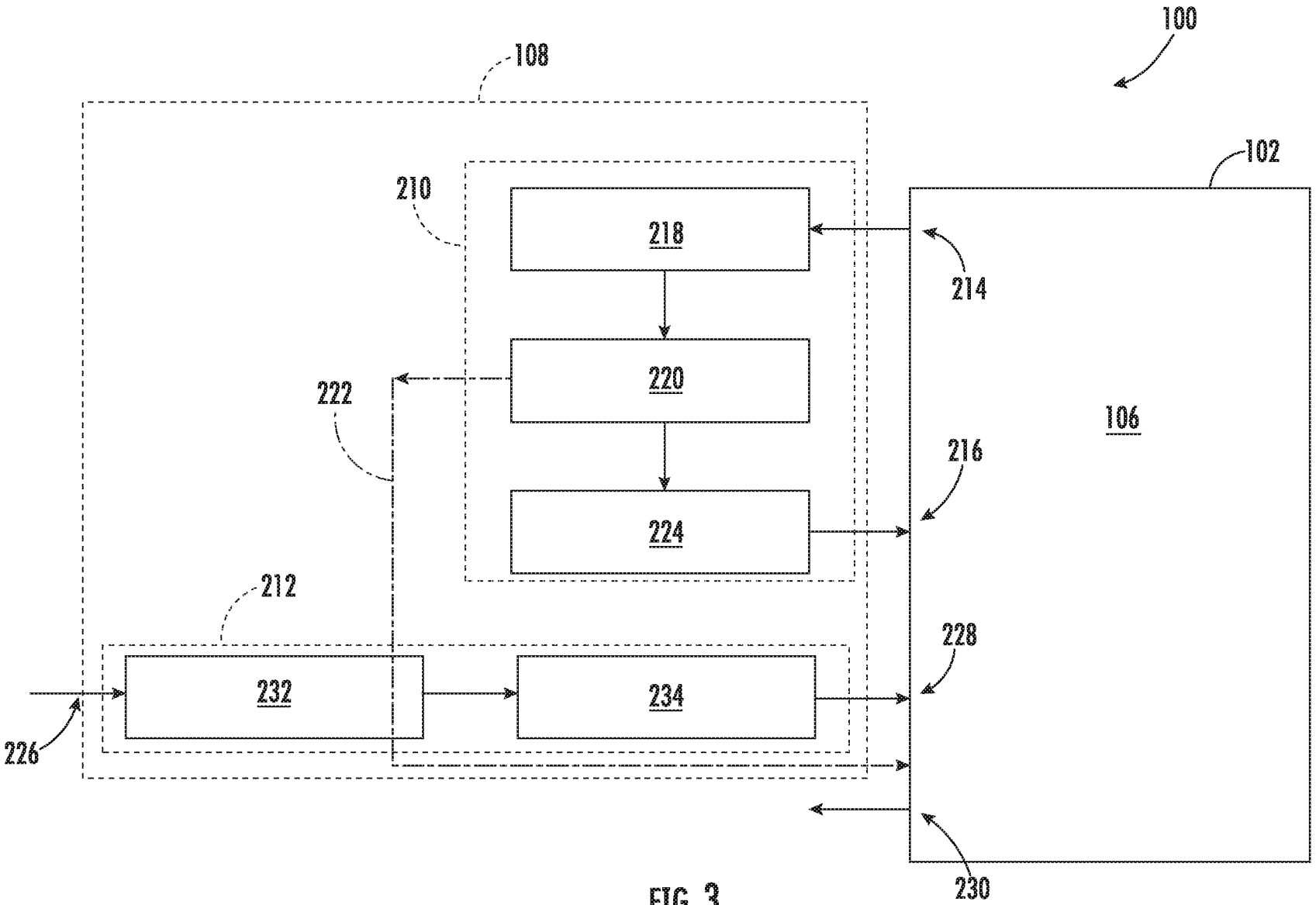
FIG. 3 provides a schematic view of the exemplary dishwashing appliance of FIG. 1.
Figure 4:
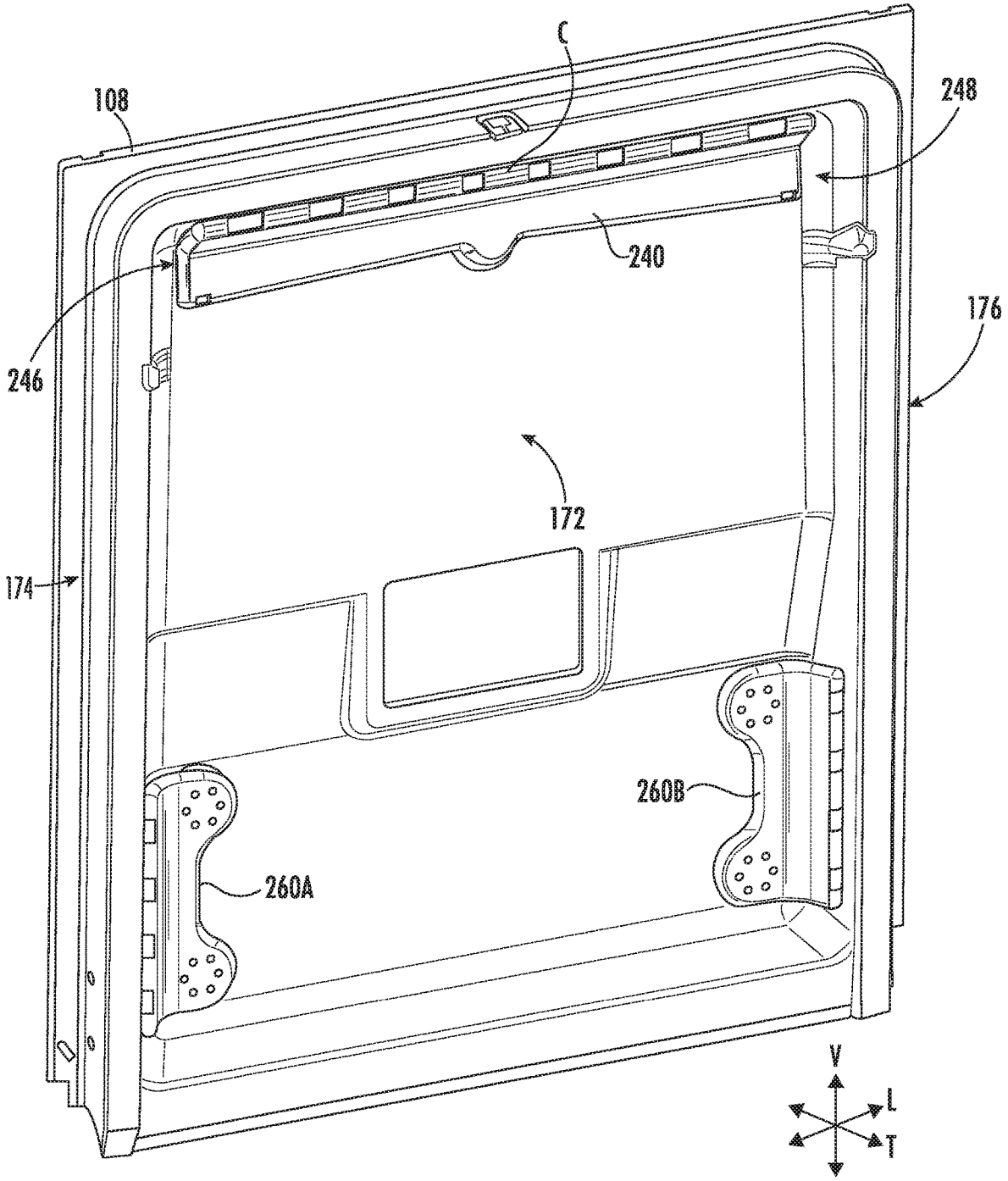
FIG. 4 provides a perspective view of a door of a dishwashing appliance according to exemplary embodiments of the present disclosure.
Figure 5:
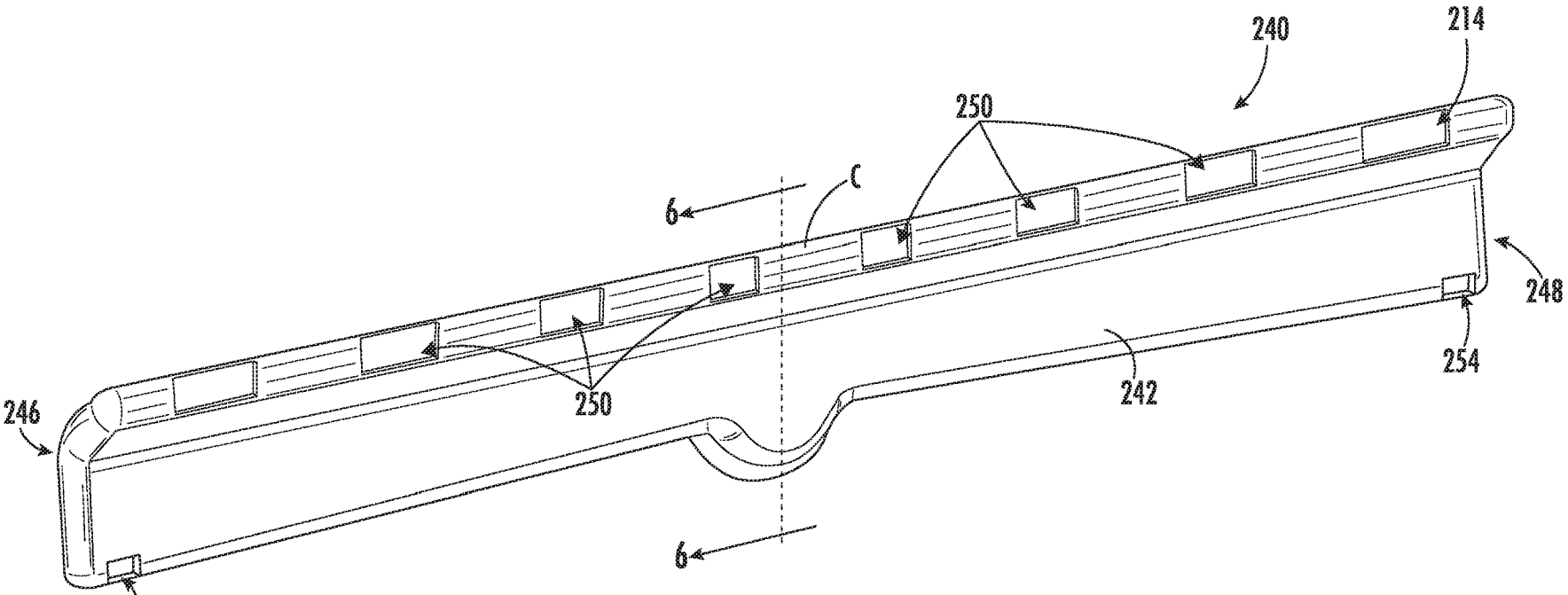
FIG. 5 provides a front perspective view of the fluid intake nozzle of the door of FIG. 4.
Figure 6:
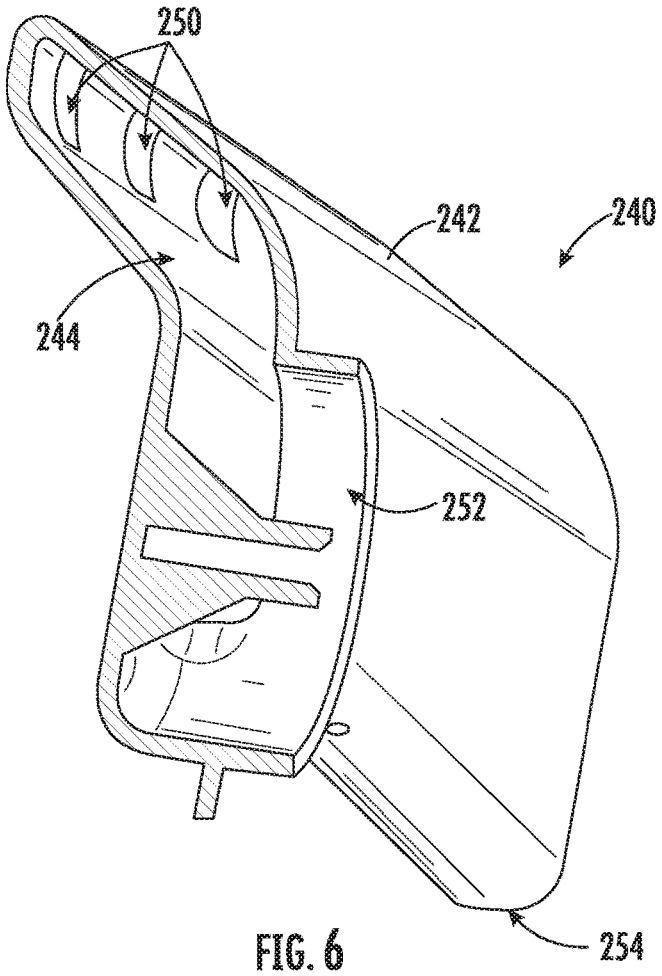
FIG. 6 provides a section view of the fluid intake nozzle of FIG. 5, taken along the lines 6-6.
Figure 7:
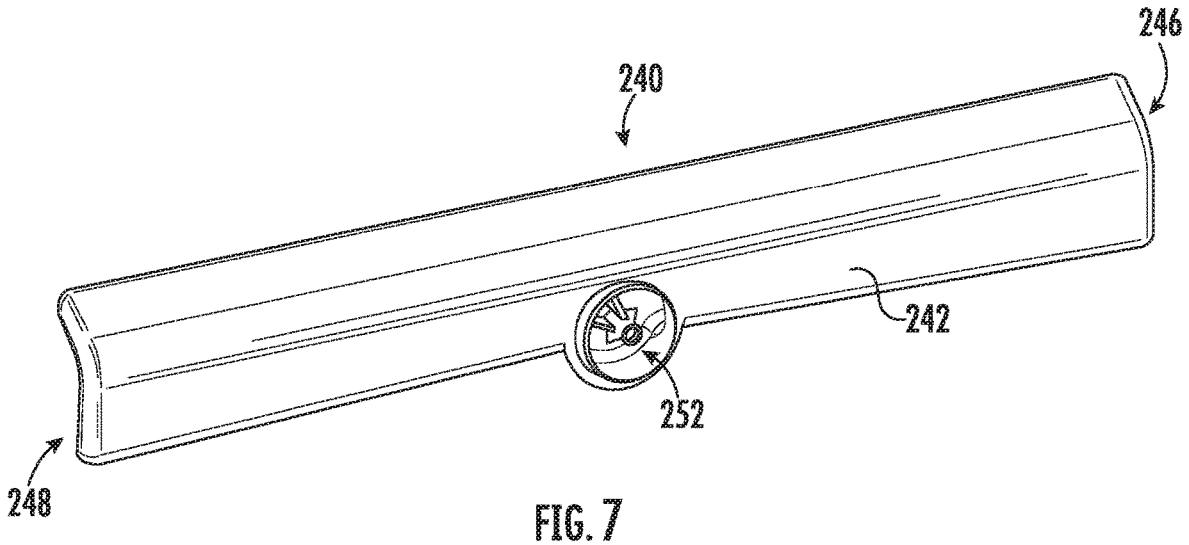
FIG. 7 provides a rear perspective view of the fluid intake nozzle of FIG. 5.
Figure 8:
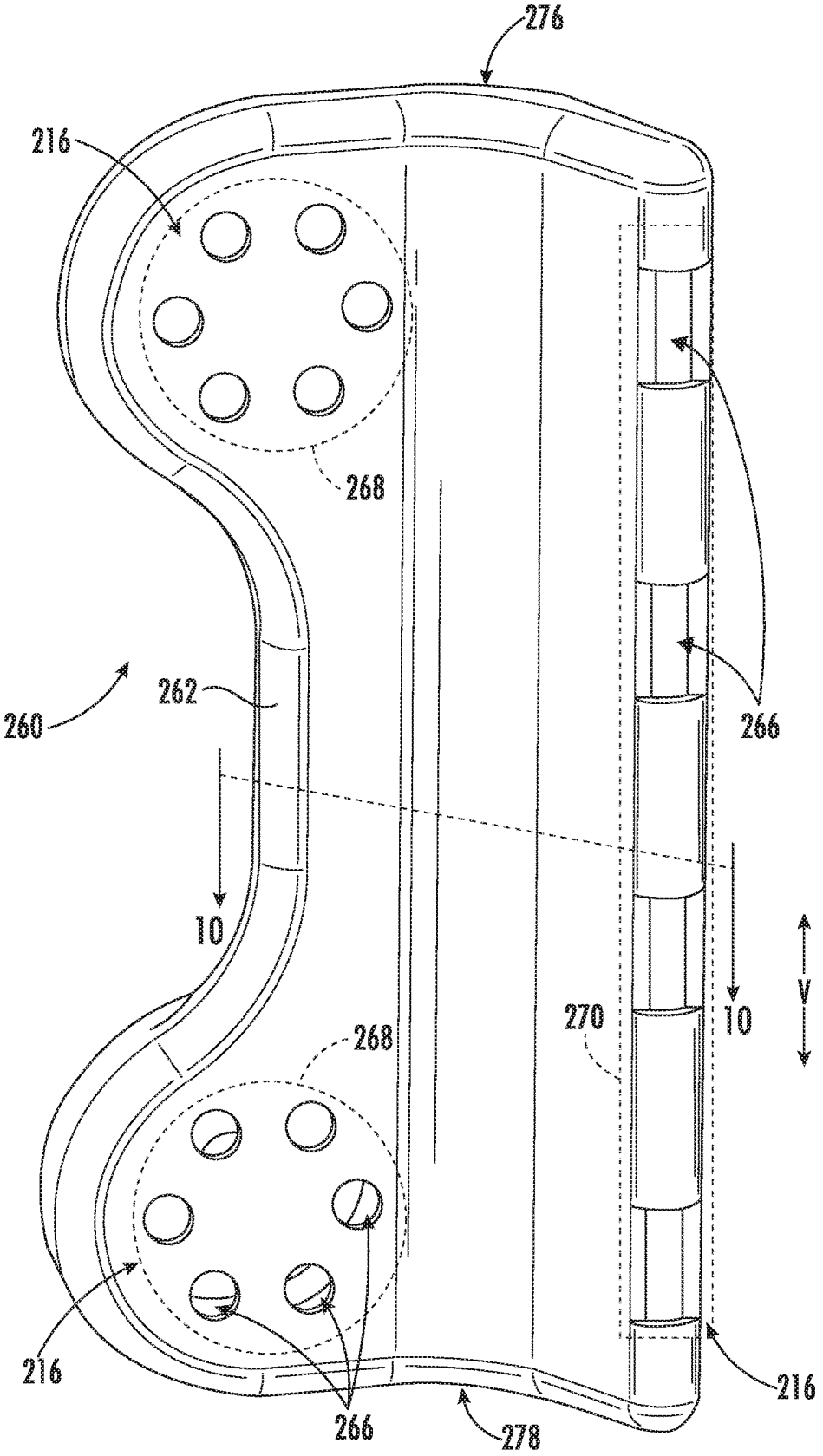
FIG. 8 provides a front perspective view of a fluid output nozzle of the door of FIG. 4.
Figure 9:
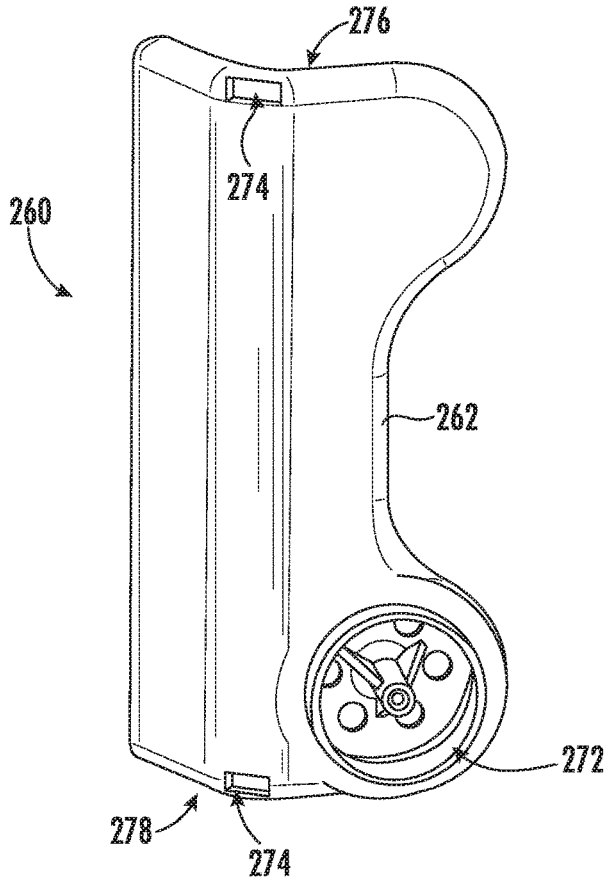
FIG. 9 provides a rear perspective view of the fluid output nozzle of FIG. 9.
Figure 10:
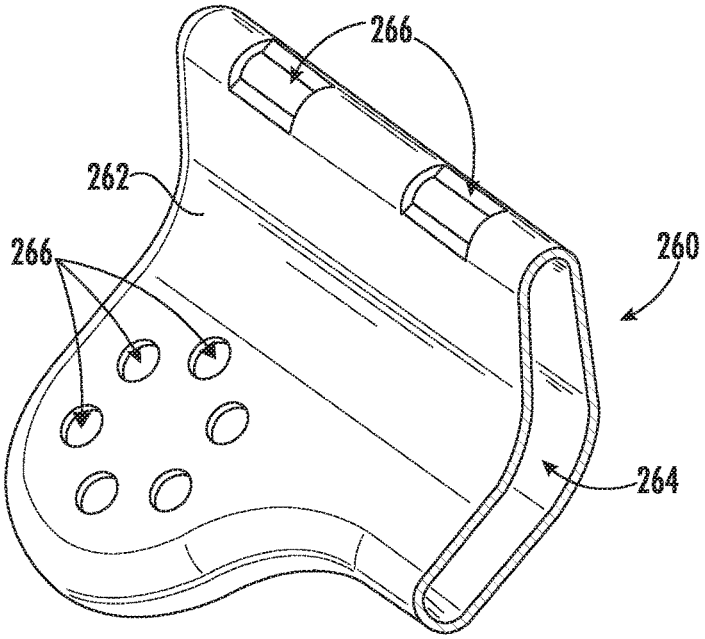
FIG. 10 provides a section view of the fluid intake nozzle of FIG. 8, taken along the lines 10-10.

Turning now to FIGS. 2 through 4, FIG. 3 provides a schematic view of dishwashing appliance 100, including features of a multi-zone drying assembly. FIG. 4 provides a perspective view of door 108, such that an inner surface 172 that would generally face wash chamber 106 (FIG. 2) is visible.

As illustrated, multiple discrete fluid paths 210, 212 are provided to selectively circulate air or vapor through dishwashing appliance 100 (e.g., as part of a drying or dry cycle). In particular, a discrete first fluid path 210 and second fluid path 212 may be provided to dry air and articles within dishwashing appliance 100. As will be described in greater detail below, during use, first fluid path 210 may generally permit the recirculation of air through wash chamber 106 while second fluid path 212 generally permits ambient air to flow from outside cabinet 102 to wash chamber 106.

As shown, first fluid path 210 extends from a first path inlet 214 to a first path outlet 216. Specifically, first path inlet 214 is defined (e.g., at an intake nozzle bar 240) in fluid communication between wash chamber 106 and first path outlet 216. First path outlet 216 is defined (e.g., at a first output nozzle 260A—FIG. 4) downstream from first path inlet 214, in fluid communication between first path inlet 214 and wash chamber 106. For instance, first path outlet 216 may be defined below first path inlet 214. Air or vapor may thus exit wash chamber 106 and enter first fluid path 210 through first path inlet 214 (e.g., defined on or within door 108). From first path inlet 214, at least a portion of the received air or vapor may flow through first fluid path 210 before returning to wash chamber 106 through first path outlet 216. Optionally, first path outlet 216 may be aligned (e.g., vertically) with lower rack 122. Thus, first path outlet 216 may be directed toward and at the same height as lower rack 122. Air returning to wash chamber 106 may advantageously flow to articles held on or within lower rack.

Generally, and as would be understood in light of the present disclosure, first fluid path 210 may be formed from one or more conduits or contained channels mounted or defined within dishwashing appliance 100. For instance, first fluid path 210 may be defined by one or more continuous air ducts mounted within door 108 and connecting first path inlet 214 to first path outlet 216.

Along first fluid path 210 a first fan or blower 218 may be provided to motivate air or vapor from first path inlet 214 to first path outlet 216. Generally, first fan 218 may include or be provided as any suitable air handler, such as an axial fan, tangential fan, etc. When assembled, first fan 218 may be positioned between the first path inlet 214 and first path outlet 216 (i.e., downstream from first path inlet 214 and upstream from first path outlet 216). Moreover, first fan 218 may be in operative (e.g., electrical or wireless) communication with controller 146. Controller 146 may thus selectively direct first fan 218 to rotate or otherwise motivate air through first fluid path 210.

In certain embodiments, a condenser 220 is mounted along first fluid path 210. Specifically, condenser 220 is mounted between the first path inlet 214 and first path outlet 216 (i.e., downstream from first path inlet 214 and upstream from first path outlet 216). At least a portion of air or vapor flowing from first path inlet 214 to first path outlet 216 may thus be forced over or across condenser 220. Optionally, condenser 220 may be downstream from first fan 218. Generally, condenser 220 may include or be provided as any suitable structure to cool or otherwise condense water vapor within first fluid path 210. As an example, condenser 220 may include an active cooling element, such as a piezoelectric heat exchanger or an evaporator coil of a sealed cooling system, which is configured to transfer heat from air or vapor within the surrounding environment to a compressor-motivated refrigerant (e.g., as directed by an activation signal received from controller 146). As an additional or alterative example, condenser 220 may include a passive cooling element, such as a conductive metal plate or fin array. As would be understood, at least a portion of water vapor contacting the passive cooling element may thus cool and condense to a liquid state as fluid is motivated through first fluid path 210.

A liquid drain 222 may be provided to direct or guide condensed liquid away from condenser 220. In some embodiments, liquid drain 222 extends from first fluid path 210 at condenser 220. For instance, liquid drain 222 may include one or more liquid conduits connected to first fluid path 210 on or below condenser 220. Liquid drain 222 may terminate outside of first fluid path 210. As an example, liquid drain 222 may terminate outside of dishwashing appliance 100 such that condensed liquid can flow from first fluid path 210 to, for example, a municipal water supply. As an additional or alternative example, liquid drain 222 may terminate at tub 104 or otherwise within wash chamber 106 (e.g., within tub sump portion 152 or another location below lower rack assembly 122) such that condensed liquid can flow from first fluid path 210 back to wash chamber 106 without flowing over and further wetting any articles contained therein.

In additional or alternative embodiments, an air absorption element 224 is mounted along first fluid path 210. Specifically, air absorption element 224 is mounted between the first path inlet 214 and first path outlet 216 (i.e., downstream from first path inlet 214 and upstream from first path outlet 216). At least a portion of air or vapor flowing from first path inlet 214 to first path outlet 216 may thus be forced through air absorption element 224. Optionally, air absorption element 224 may be downstream from first fan 218 or condenser 220. Generally, condenser 220 may include or be provided as any suitable structure to absorb or otherwise draw water vapor from air within first fluid path 210. As an example, air absorption element 224 may include a desiccant material mounted within first fluid path 210. As would be understood, at least a portion of water vapor contacting the desiccant material may thus become trapped within the desiccant material while air continues to flow through first fluid path 210 (e.g., to first path outlet 216).

During use, such as during a dry cycle, a heated, humid airflow (e.g., 160° Fahrenheit, 95% relative humidity) may enter first fluid path 210 at first path inlet 214. Through first path inlet 214, some vapor or moisture within the air may be condensed or otherwise removed (e.g., at condenser 220 or air absorption element 224). Additionally or alternatively, the airflow may be cooled slightly. Optionally, first fluid path 210 may be free of any heater or active heating element. Air may thus be returned to wash chamber 106 through first path outlet 216 as a chilled, humid airflow (e.g., 140° Fahrenheit, 95% relative humidity).

Separate from first fluid path 210, second fluid path 212 extends from a second path inlet 226 to a second path outlet 228. Specifically, second path inlet 226 is defined (e.g., through door 108 or cabinet 102) in fluid communication between an ambient environment surrounding cabinet 102 and a second path outlet 228. Second path outlet 228 is defined (e.g., at a second output nozzle 260B—FIG. 4) downstream from second path inlet 226, in fluid communication between second path inlet 226 and wash chamber 106. Ambient air may thus enter second fluid path 212 through second path inlet 226 (e.g., defined on or within door 108). From second path inlet 226, at least a portion of the ambient air may flow through second fluid path 212 before entering wash chamber 106 through second path outlet 228.

Optionally, second path outlet 228 may be defined below first path inlet 214. Additionally or alternatively, second path outlet 228 may be aligned (e.g., vertically and laterally) with lower rack or silverware basket. Thus, second path outlet 228 may be directed toward and at the same height as lower rack 122 or silverware basket 170. Relatively dry ambient returning may advantageously flow to articles held on or within lower rack or silverware basket, where condensation may otherwise be especially likely to gather (e.g., due to the relatively high surface area to volume of articles therein).

As shown, an ambient outlet 230 may further be spaced apart from second fluid path 212 and defined in fluid communication between wash chamber 106 and the ambient environment. Air may thus be permitted to escape wash chamber 106 through ambient outlet 230. For instance, increased pressure generated within wash chamber 106 by the flow of ambient air through second fluid path 212 may force a portion of air within wash chamber 106 through ambient outlet 230 and to the ambient environment. Generally, ambient air outlet may be defined at any suitable location through door 108 or cabinet 102. For instance, as illustrated, ambient outlet 230 may be defined as an opening formed between a front end of tub 104 and an inner surface 172 of door 108 in the closed position.

Along second fluid path 212 a second fan or blower 232 may be provided to motivate ambient air from second path inlet 226 to second path outlet 228. Generally, second fan 232 may include or be provided as any suitable air handler, such as an axial fan, tangential fan, etc. When assembled, second fan 232 may be positioned between the second path inlet 226 and second path outlet 228 (i.e., downstream from second path inlet 226 and upstream from second path outlet 228). Moreover, second fan 232 may be in operative (e.g., electrical or wireless) communication with controller 146. Controller 146 may thus selectively direct second fan 232 to rotate or otherwise motivate air through second fluid path 212.

In certain embodiments, a heating element 234 is mounted along second fluid path 212. Specifically, heating element 234 is mounted between the second path inlet 226 and second path outlet 228 (i.e., downstream from second path inlet 226 and upstream from second path outlet 228). At least a portion of air or vapor flowing from second path inlet 226 to second path outlet 228 may thus be forced over or across heating element 234. Optionally, heating element 234 may be downstream from second fan 232. Generally, heating element 234 may include or be provided as any suitable structure to generate heat within second fluid path 212. As an example, heating element 234 include an electric heater (e.g., resistive wire or ceramic rod, piezoelectric heater, radiant heater element, etc.), which is configured to transfer heat to air within the surrounding environment (e.g., second fluid path 212). Moreover, heating element 234 may be in (e.g., electrical or wireless) communication with controller 146 and may generate heat as directed by an activation signal received from controller 146.

During use, such as during a dry cycle, an ambient airflow may enter second fluid path 212 at second path inlet 226. Through second path inlet 226, the temperature of air may be increased (e.g., as heat is generated at heating element 234). Air may thus be directed to wash chamber 106 through second path outlet 228 as a heated, dry airflow (e.g., 140° Fahrenheit, 10% relative humidity).

It is noted that although first and second fluid paths 210, 212 are shown as being generally positioned within or through door 108, additional or alternative embodiments may include one or both of first and second fluid paths 210, 212 within another portion of dishwashing appliance 100, such as within a cabinet 102 and through one or more sidewall 164.

Turning now to FIGS. 4 through 7, FIGS. 5, 6, and 7 provide various perspective views of intake nozzle bar 240, in isolation and apart from door 108. As shown, intake nozzle bar 240 includes a nozzle body 242 that generally extends (e.g., along the lateral direction L) between a first bar end 246 and a second bar end 248. When assembled and mounted on door 108, intake nozzle bar 240 is mounted on inner surface 172 such that intake nozzle bar 240 is generally positioned in and in fluid communication with wash chamber 106 when door 108 is in the closed position. For instance, intake nozzle bar 240 may be generally centered (e.g., relative to the lateral direction L) between a first side 174 of door 108 and a second side 176 of door 108. First bar end 246 may be positioned proximal to first side 174 while second bar end 248 is positioned proximal to second side 176. In other words, the first bar end 246 may be located closer to first side 174 than it is second side 176, and the second bar end 248 may be located closer to second side 176 than it is first side 174.

As shown, intake nozzle bar 240 defines one or more intake apertures 250 (e.g., at a front end of nozzle body 242) that define first path inlet 214. For instance, a plurality of intake apertures 250 may be defined (e.g., at a top portion of nozzle body 242). Multiple (e.g., some or all) intake apertures 250 may be spaced apart from each other. For instance, the plurality of intake apertures 250 may be laterally spaced apart. Moreover, a plurality of intake apertures 250 may be directed to or communicate with a common nozzle cavity 244 that is defined by nozzle body 242. Optionally, the cross-sectional area defined by the intake apertures 250 may be varied. In other words, one intake aperture 250 may have a cross-sectional area that is different from (e.g., smaller or larger) than the cross-sectional area of another intake aperture 250. As an example, the lateral length of each intake aperture 250 may progressively and sequentially increase relative to the lateral distance from a central point C defined between first bar end 246 and second bar end 248. Thus, the lateral length of intake apertures 250 closer to the bar ends 246, 248 of intake nozzle bar 240 may be larger than the lateral length of intake apertures 250 closer to the central point C. Advantageously, an even or consistent volumetric flow rate of air into intake nozzle bar 240 may be maintained from first bar end 246 to second bar end 248.

Downstream from the intake apertures 250, nozzle bar 240 may further define an exhaust 252 (e.g., at a rear end of nozzle body 242). In some embodiments, exhaust 252 is mated to a portion of door 108, such as the inner surface 172. For instance, exhaust 252 may be defined at a portion of nozzle body 242 that is attached to or received by door 108. Optionally, exhaust 252 may be centrally positioned between first bar end 246 and second bar end 248. Additionally or alternatively, exhaust 252 may be positioned below intake apertures 250 such that air received through intake apertures 250 must generally flow downward or radially inward within nozzle cavity 244 and toward exhaust 252. From exhaust 252, air may continue through first fluid path 210, as described above.

In exemplary embodiments, one or more drain holes 254 are further defined by intake nozzle bar 240. For instance, drain holes 254 may be defined through a bottom surface of nozzle body 242 to nozzle cavity 244. Liquid within nozzle cavity 244, such as might be received through intake apertures 250, may thus be permitted to drain from intake nozzle bar 240 (e.g., and back to wash chamber 106) upstream from exhaust 252 or first path outlet 216. Optionally, separate drain holes 254 may be defined at first bar end 246 and second bar end 248. The bottom surface of nozzle body 242 may be sloped away from the central point C. As water collects within nozzle cavity 244, it may thus be motivated by gravity to the bar ends 246, 248 and through drain holes 254.

Turning now especially to FIGS. 4 and 8 through 10, FIGS. 8, 9, and 10 provide various perspective views of an output nozzle 260 (e.g., first output nozzle 260A or second output nozzle 260B), in isolation and apart from door 108. Optionally, first and second output nozzles 260A, 260B may be identical structures that may they may generally be rotated and swapped for each other (e.g., during assembly). When assembled and mounted on door 108, the first and second output nozzles 260A, 260B are mounted on inner surface 172 (e.g., at discrete lateral ends or locations) such that both output nozzles 260A, 260B are generally positioned in and in fluid communication with wash chamber 106 when door 108 is in the closed position. Optionally, both output nozzles 260A, 260B may be mounted at the same general height (e.g., below intake nozzle bar 240). Additionally or alternatively, first output nozzle 260A may be positioned proximal to first side 174 while second output nozzle 260B is positioned proximal to second side 176. In other words, the first output nozzle 260A may be located closer to first side 174 than it is second side 176, and the second output nozzle 260B may be located closer to second side 176 than it is first side 174.

As shown, output nozzle 260 defines one or more output apertures 266 (e.g., at a front end of nozzle body 262) that define first path outlet 216 or second path outlet 228. Specifically, the output apertures 266 of first output nozzle 260A define first path outlet 216, and the output apertures 266 of second output nozzle 260B define second path outlet 228. Optionally, multiple aperture regions, each including several output apertures 266, may be defined. As an example, multiple vertically-spaced circular regions 268 may be defined. As an additional or alternative example, a linear region 270 may be defined. Advantageously, the output nozzle 260 may be readily reversed and rotated to provide a common or similar airflow on either side 174, 176 (e.g., depending on whether output nozzle 260 is installed as a first or second output nozzle 260B). The plurality of output apertures 266 may extend from or communicate with a common nozzle cavity 264 is defined by nozzle body 262. Thus, a plurality of output apertures 266 of a corresponding output nozzle 260 may all receive air from the same nozzle cavity 264.

Upstream from the output apertures 266, output nozzle 260 may further define an entrance 272 (e.g., at a rear end of nozzle body 262). In some embodiments, entrance 272 is mated to a portion of door 108, such as the inner surface 172. For instance, entrance 272 may be defined at a portion of nozzle body 262 that is attached to or received by door 108. Optionally, entrance 272 may be proximal to one circular region 268 of output apertures 266 (e.g., closer to one vertical extrema). Entrance 272 may be downstream from either first fluid path 210 or second fluid path 212 (e.g., according to the first or second output nozzle 260B). Air may be thus be received from first fluid path 210 or second fluid path 212, as described above. From entrance 272, air may pass through nozzle cavity 264 and to the output apertures 266 before flowing to wash chamber 106, as also described above.

In exemplary embodiments, one or more drain holes 274 are further defined by output nozzle 260 (e.g., as first or second output nozzle 260A or 260B). For instance, a drain hole 274 may be defined through a bottom surface of nozzle body 262 to nozzle cavity 264. Liquid within nozzle cavity 264, such as might be received through entrance 272 or output apertures 266 (e.g., during a wash cycle), may thus be permitted to drain from output nozzle 260 (e.g., and back to wash chamber 106) upstream from the output apertures 266. In other words, water may be permitted to drain from output nozzle 260 before one or more of the fans 218, 232 motivates it through the output apertures 266. Optionally, separate drain holes 274 may be defined at a top end 276 and bottom end 278 of nozzle body 262 (e.g., at both vertical ends of output nozzle 260). Irrespective of orientation, the bottom surface of nozzle body 262 may thus define a drain hole 274. As water collects within nozzle cavity 264, it may thus be motivated by gravity to through drain hole 274 in either the first output nozzle 260A or the second output nozzle 260B.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance comprising:

a cabinet;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a door rotatably attached to the cabinet to selectively restrict access to the wash chamber in a closed position, the door extending from a first side to a second side;

a first fluid path extending from a first path inlet to a first path outlet to recirculate air within the wash chamber, the first path inlet defined in fluid communication between the wash chamber and the first path outlet, and the first path outlet defined in fluid communication between the first path inlet and the wash chamber downstream from the first path inlet; and a second fluid path extending from a second path inlet to a second path outlet to direct ambient air to the wash chamber, the second path inlet being defined in fluid communication between an ambient environment surrounding the dishwashing appliance and the second path outlet, and the second path outlet defined in fluid communication between the second path inlet and the wash chamber downstream from the second path inlet, wherein the first path outlet is on an inner surface of the door proximal to the first side, and wherein the second path outlet is defined on the inner surface of the door proximal to the second side.

2. The dishwashing appliance of claim 1, further comprising a condenser mounted along the first fluid path between the first path inlet and the first path outlet.

3. The dishwashing appliance of claim 2, further comprising a liquid drain extending from the first fluid path at the condenser.

4. The dishwashing appliance of claim 3, wherein the liquid drain terminates at the tub.

5. The dishwashing appliance of claim 1, further comprising a heating element mounted within the second fluid path between the second path inlet and the second path outlet to selectively heat air directed to the wash chamber from the second fluid path.

6. The dishwashing appliance of claim 1, wherein the first path inlet is positioned above the first path outlet.

7. The dishwashing appliance of claim 6, wherein the first path inlet is positioned above the second path outlet.

8. The dishwashing appliance of claim 1, further comprising a door rotatably attached to the cabinet to selectively restrict access to the wash chamber in a closed position, wherein the first fluid path and the second fluid path are defined through the door.

9. The dishwashing appliance of claim 8, wherein an ambient outlet defined in fluid communication between the wash chamber and the ambient environment, the ambient outlet being defined between the tub and the door in the closed position.

10. The dishwashing appliance of claim 1, further comprising a silverware basket selectively mounted within the wash chamber, wherein the second path outlet is vertically aligned with the silverware basket to direct an ambient airflow thereto.

11. The dishwashing appliance of claim 1, further comprising a lower rack mounted within the wash chamber, wherein the first path outlet is vertically aligned with the lower rack to direct a recirculated airflow thereto.

12. A dishwashing appliance comprising:

a cabinet defining a mutually-perpendicular vertical direction, lateral direction, and transverse direction;

a tub housed within the cabinet and defining a wash chamber;

a pump configured to deliver a wash fluid to the wash chamber;

a spray assembly housed within the wash chamber of the tub in fluid communication with the pump to receive wash fluid therefrom;

a door rotatably attached to the cabinet to selectively restrict access to the wash chamber in a closed position, the door extending in the lateral direction from a first side to a second side;

an intake nozzle bar mounted on an inner surface of the door, the intake nozzle bar extending in the lateral direction between a first end proximal to the first side and a second end proximal to the second side;

a first output nozzle mounted on the inner surface of the door proximal to the first side;

a second output nozzle mounted on the inner surface of the door proximal to the second side;

a first fluid path extending from a first path inlet defined at the intake nozzle bar to a first path outlet defined at the first output nozzle to recirculate air within the wash chamber; and a second fluid path extending from a second path inlet to a second path outlet defined at the second output nozzle to direct ambient air to the wash chamber.

13. The dishwashing appliance of claim 12, wherein the intake nozzle bar defines a plurality of intake apertures laterally spaced apart from each other.

14. The dishwashing appliance of claim 13, wherein the intake nozzle bar further defines a plurality of drain holes below the intake apertures to permit liquid to drain from the intake nozzle bar to the wash chamber upstream from the first path outlet.

15. The dishwashing appliance of claim 14, wherein a bottom surface of the intake nozzle bar is sloped from a center point to the plurality of drain holes.

16. The dishwashing appliance of claim 12, wherein the first output nozzle and the second output nozzle are positioned below the intake nozzle bar.

17. The dishwashing appliance of claim 12, wherein the second output nozzle defines a plurality of output apertures and a drain hole, the drain hole of the second output nozzle being defined through a bottom surface of the second output nozzle below the plurality of output apertures to permit liquid to drain from the second output nozzle to the wash chamber.

18. The dishwashing appliance of claim 12, further comprising an ambient outlet defined in fluid communication between the wash chamber and an ambient environment, the ambient outlet being defined between the tub and the door in the closed position.

19. The dishwashing appliance of claim 12, further comprising a silverware basket selectively mounted within the wash chamber, wherein the second path outlet is vertically aligned with the silverware basket to direct an ambient airflow thereto.

20. The dishwashing appliance of claim 12, further comprising a lower rack mounted within the wash chamber, wherein the first path outlet is vertically aligned with the lower rack to direct a recirculated airflow thereto.

* * * * *